United States Patent [19]

Marx et al.

[11] Patent Number: 4,589,169

[45] Date of Patent: May 20, 1986

[54] APPARATUS FOR PRODUCTION OF A NON-WOVEN FABRIC

[75] Inventors: Karl Marx, Radebeul; Peter Offermann, Dresden; Ralf-Dieter Reumann, Dresden; Matthias Mägel, Dresden; Bertram Frenzel; Dietmar Grenzendörfer, both of Karl Marx Stadt, all of German Democratic Rep.

[73] Assignee: VEB Kombinat Textima, Karl Marx Stadt, German Democratic Rep.

[21] Appl. No.: 570,131

[22] Filed: Jan. 12, 1984

[30] Foreign Application Priority Data

Mar. 25, 1983 [DD] German Democratic Rep. ... 249171
Mar. 25, 1983 [DD] German Democratic Rep. ... 249172

[51] Int. Cl.[4] ..... D01G 25/00

[52] U.S. Cl. ..... 19/304; 19/296; 19/299; 19/161.1; 28/102

[58] Field of Search ..... 19/304, 161.1, 163, 19/296, 299, 301, 302; 28/102

[56] References Cited

U.S. PATENT DOCUMENTS

| | | | |
|---|---|---|---|
| 3,134,145 | 5/1964 | Miller | 19/299 X |
| 3,364,538 | 1/1968 | Murphy | 19/304 X |
| 3,760,458 | 9/1973 | Pitt | 19/299 X |
| 3,879,820 | 4/1975 | Grieves et al. | 19/163 X |
| 3,934,312 | 1/1976 | Trout | 19/299 X |
| 4,280,253 | 7/1981 | Holt | 19/161.1 X |

*Primary Examiner*—Louis K. Rimrodt
*Assistant Examiner*—J. L. Olds
*Attorney, Agent, or Firm*—Jordan and Hamburg

[57] ABSTRACT

A non-woven fabric is produced by the transportation of a fiber flow at an angle which is less than 90° to the transport direction of the non-woven fabric to be manufactured, with the feed rate of the fiber flow being controlled, the fibers which are to form a fiber layer being placed next to one another, and with the formed fiber layer, including lateral border areas of the fiber layers, being combined with the preceding fiber layer, reinforcing the produced non-woven fabric. The angle of the fiber flow to the transport direction of the non-woven fabric to be manufactured is set between 0° and 89°. The controlling of the fiber flow comprises monitoring of the quantity feed rate and/or dissociation of the fiber flow and/or fiber mixing, immediately prior to the formation of a fiber layer. In order to combine the formed fiber layer with the preceding fiber layer, this is placed adjacent to the formed fiber layer, or placed on at least one formed fiber layer. In the present apparatus for the execution of the method for the production of a non-woven fabric, one or more fiber feed rate control devices, each connected to a traverse drive unit, are arranged to one or more fiber flow transport devices, below an angle of 90° to the transport direction of the non-woven fabric to be manufactured, and assigned to an already known non-woven fabric transport device. The fiber feed rate control device contains a rotation unit. The fiber feed rate control device is arranged at the beginning or above the non-woven fabric transport device. The traverse drive is formed as a pivot drive. In order to dissolve the fiber flow consisting of fibers, adhesively connected to one another, the fiber feed rate control arrangement contains a dissolving roll. The fiber feed rate control device and the traverse drive unit have variable speed motors for the required adjustment of the fiber flow feed rate to the delivery speed of the non-woven fabric, depending on the surface measurement of the non-woven fabric to be produced and the reinforcement speeds. The traverse drive unit has working width position stops.

6 Claims, 8 Drawing Figures

APPARATUS FOR PRODUCTION OF A NON-WOVEN FABRIC

BACKGROUND OF THE INVENTION AND PRIOR ART STATEMENT

The invention relates to a method and an apparatus for production of a non-woven fabric, preferably for textile sheets.

It is known that non-woven fabrics can be produced mechanically and/or aerodynamically and/or hydrodynamically, with the fiber material being dispersed mechanically and/or aerodynamically into individual fibers, with a fiber nap or non-woven fabric being simultaneously formed, deposited, and transported over the entire working width. Most technical solutions disclose carding power units for the mechanical non-woven fabric formation over the entire working width. The processing of the fiber naps into non-woven fabric is accomplished by layering or paneling. In accordance with the preferred fiber direction of the fiber nap or non-woven fabric, the result can be longitudinal fleece, lateral fleece, cross fleece and irregular fleece (Boettcher, P. et al.: Vliesstoffe, VEB Fachbuchverlag Leipzig 1976).

It is furthermore known that a non-woven fabric can be mechanically produced by means of a meander-shaped fiber track, located perpendicular to the the transport direction of the non-woven fabric. According to DE-OS No. 1 926 951 the fiber track, and according to DE-OS No. 2 846 517 a fiber hank, are moved translatorily back and forth by an air stream over the respective working width, thus reaching the essentially parallel reaming position.

Poor mass uniformity over the width and length of the fleece, a lower degree of variability of the fiber orientation in the individual fiber layers of the fleece and across the fleece width, insufficient texture variability, as well as few pattern possibilities, are commmon disadvantages connected with these methods and apparatus. Even if the meander-shaped fleece formation from a fiber track and the loop-shaped fiber hank depot have the advantage of width variability, they also display the obvious disadvantages of periodic mass fluctuations depending on the fiber track or the fiber hank depot, with related bandiness, irregularities in the inversion or border areas, and low variability of the fiber orientation and the non-woven fabric texture.

SUMMARY OF THE INVENTION

It is an object of the invention to provide a method and an apparatus for the production of non-woven fabrics, preferably for textile sheets, with improved functional value and low production costs.

It is another object of the invention to provide a method and an apparatus for the formation of a non-woven fabric with variable working width, extensive structure variability as regards thickness, surface, type of fiber, fiber arrangement and color, as well as high mass uniformity, with simple technical expenditures.

These and other objects and advantages of the present invention will become evident from the description which follows.

The objects are accomplished in the invention in that the method for the production of a non-woven fabric provides for the transportation of a fiber flow at an angle which is less than 90° to the transport direction of the non-woven fabric to be manufactured, with the feed rate of the fiber flow being controlled, the fibers which are to form a fiber layer being placed next to one another, and with the formed fiber layer, including lateral border areas of the fiber layers, being combined with the preceding fiber layer, reinforcing the produced non-woven fabric. The angle of the fiber flow to the transport direction of the non-woven fabric to be manufactured is set between 0° and 89°. The controlling of the fiber flow comprises monitoring of the quantity feed rate and/or dispersement of the fiber flow and/or fiber mixing, immediately prior to the formation of a fiber layer. In order to combine the formed fiber layer with the preceding fiber layer, this is placed adjacent to the formed fiber layer, or placed on at least one formed fiber layer. The fiber flow is formed of fibers, adhesively connected to one another, or of air-carried fibers, or of fibers carried by a liquid medium. Furthermore, the fiber flow is formed or irregular fibers or directional fibers. The fiber flow can also be formed of several partial fiber flows, located next to one another and/or above one another, having different fiber orientation and/or fiber thickness and/or fiber length and/or fiber type and/or color.

In an apparatus for the execution of the method for the production of a non-woven fabric, one or more fiber feed rate control devices, each connected to a traverse drive unit, are arranged to one or more fiber flow transport devices, below an angle of 90° to the transport direction of the non-woven fabric to be manufactured, and assigned to an already known non-woven fabric transport device. The fiber feed rate control device contains a rotation unit. The fiber feed rate control device is arranged at the beginning or above the non-woven fabric transport device. The traverse drive is formed as a pivot drive. In order to disperse the fiber flow consisting of fibers, adhesively connected to one another, the fiber feed rate control arrangement contains a dispersing roll. The fiber feed rate control device and the traverse drive unit have variable speed motors for the required adjustment of the fiber flow feed rate to the delivery speed of the non-woven fabric, depending on the surface measurement of the non-woven fabric to be produced and the reinforcement speeds. The traverse drive unit has working width position stops.

The functional value of the non-woven fabric or the textile sheet produced by reinforcement, as well as their structure and pattern characteristics, are considerably improved and enlarged by the method of the invention. Most advantageous is, on the one hand, the higher mass uniformity, which can be regulated by the fiber feed rate, over the width and length of the non-woven fabric, with the entire width of the non-woven fabric, including the border areas, being used for the sheet formation with only minimal material losses, and, on the other hand, the intentional mass fluctuations for structural effects. The new non-woven fabric and the higher functional value can be achieved with simple technical means, resulting in the essential prerequisites for the economical use of non-woven materials in new areas of use, as well as economical, more advantageous use in typical fleece material assortments.

The invention accordingly consists in the method and apparatus for production of a non-woven fabric as described supra, and as will appear infra from the detailed description of the drawings and preferred embodiments, and as elucidated in the appended claims.

BRIEF DESCRIPTION OF THE DRAWINGS

The invention will be explained in detail by means elements and members as shown in the drawings.

The drawings show the following.

DETAILED DESCRIPTION OF THE PREFERRED EMBODIMENTS

Figure 1:
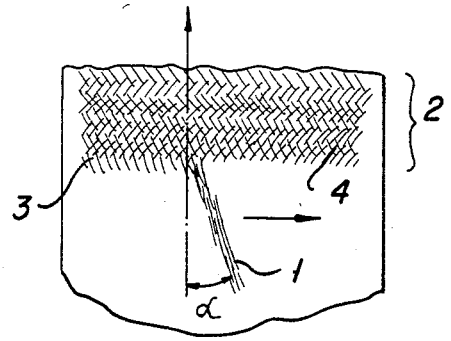
FIG. 1 shows the production of a non-woven fabric from a fiber flow of directional fibers at an angle of $0 < \alpha < 90°$ to the non-woven material transport direction.
Figure 2:
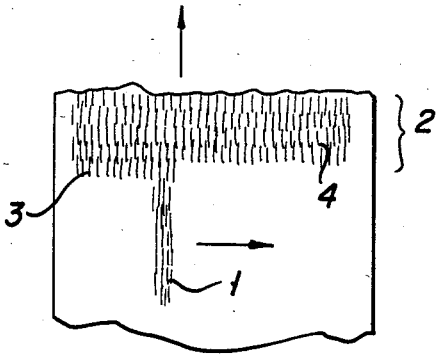
FIG. 2 shows the production of a non-woven fabric from a fiber flow of directional fibers at an angle of 0° to the non-woven fabric transport direction.
Figure 3:
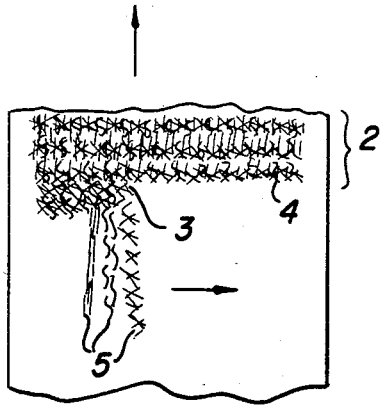
FIG. 3 shows the production of a non-woven fabric from a partial fiber flow of various fiber types and orientation; at an angle of 0° to the non-woven fabric transport direction

Referring now to the drawings, the fiber flow 1 is transported at an angle which, according to FIG. 1, is smaller than 90°, and in the most simple case, according to FIG. 2, is 0° to the transport direction of the non-woven fabric 2 to be manufactured, and the feed rate of the fiber flow 1 is controlled so that the dissolved fibers are continuously placed next to one another approximately across the width of the fiber flow 1 for the formation of a fiber layer 3 over the desired working width. By continuously controlling the feed rate and placing the fibers next to one another, the fibers are layered over the fiber flow width. The formed fiber layer 3, including lateral border areas of the fiber layers, is combined with the preceding fiber layer 4. The thus produced non-woven fabric 2, which has in principle been created from more or less overlapping, i.e., according to FIG. 1, with the fiber layers 3 being placed on top of one another, and according to FIG. 2, with the fiber layers being placed next to one another, is transported on for the purpose of reinforcement by arbitrary non-woven fabric methods. FIG. 1 furthermore illustrates that the angle changes with each fiber flow modulation over the working width, symmetrically to the non-woven fabric transportation, resulting in a cross-wise layering of the fibers of subsequent fiber layers in the non-woven fabric 2. In FIG. 3, several partial fiber flows 5, which are partly formed of directional and partly of irregular fibers, with the fiber types being different as well, are transported with controlled feed rate next to one another. The combination of several partial fiber flows, transported and with controlled feed rate next to one another, and/or above one another, results in the particular advantage that almost any desired structure and pattern can be achieved. The additional process steps occur in a manner analogous to the initially described ones.

Figure 4:
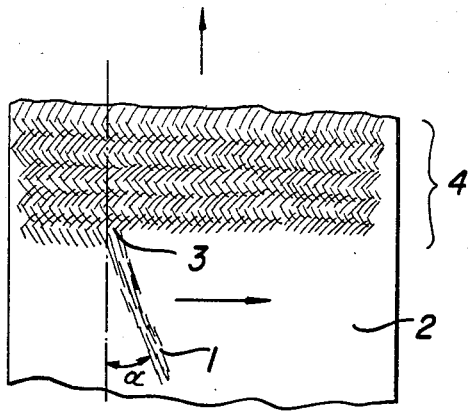
FIG. 4 shows the production of a non-woven fabric analogous to FIG. 1 on a pre-manufactured sheet.
Figure 5:
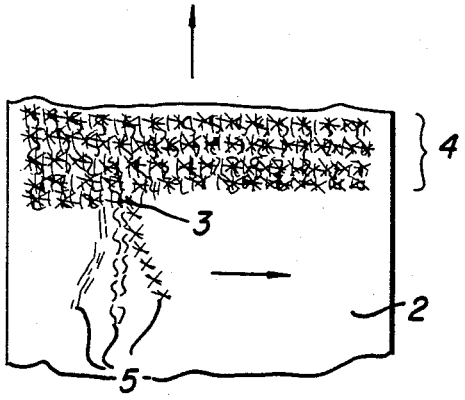
FIG. 5 shows the production of a non-woven fabric, analogous to FIG. 3 on a pre-manufactured sheet.

According to FIGS. 4 and 5, the fibers for the formation of a fiber layer 3 are placed next to one another on a supplied sheet 2, and the formed fiber layer 3 is combined, including lateral border areas of the fiber layer 3, with the preceding fiber layer 3, and the thus produced non-woven fabric 4 is reinforced together with the supplied sheet 2. For the production of a sheet, having more than two layers, the non-woven fabric 4 produced on a supplied sheet 2 is subsequently covered by an additional sheet in a sandwich-like fashion and reinforced, or several non-woven fabrics are simultaneously produced from several fiber flows, either individually and/or on a supplied sheet, and combined with additionally supplied sheets in arbitrary layering, and reinforced. The supplied sheets are textile sheets, such as woven fabrics, warp-knitted fabrics, knitted fabrics, and/or yarn sheets and/or foil ribbons and/or foils. When combining the fiber layers with one or several sheets, there is the advantage of virtually any desired structure and pattern of the non-woven fabric being achieved as a cross-section of the multi-layered sheet.

Figure 6:
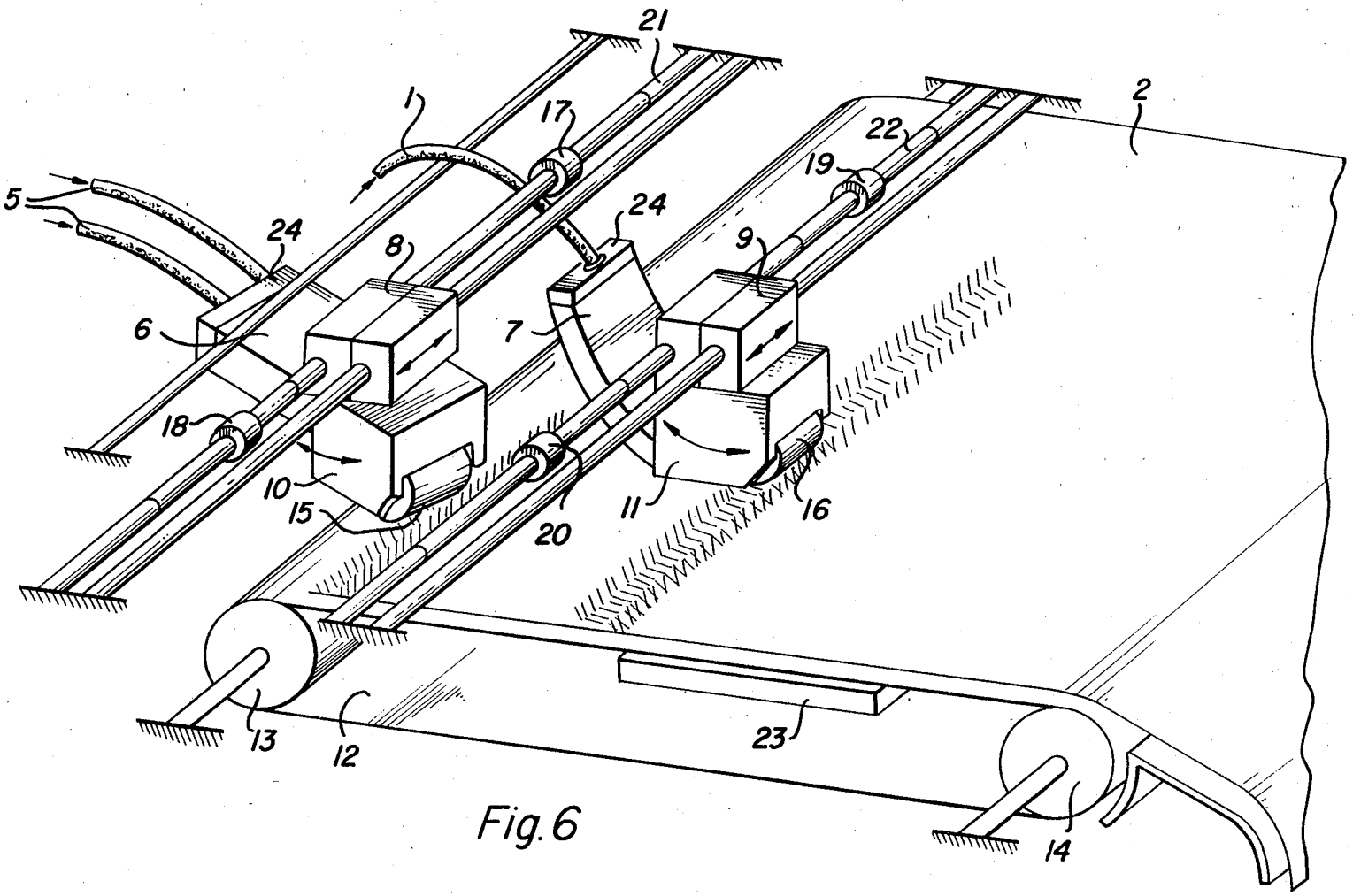
FIG. 6 is the schematic isometric depiction of the apparatus for the production of a non-woven fabric, according to FIGS. 1 to 3.

According to FIG. 6, fiber feed rate control devices 10 and 11 of a non-woven fabric transport device, consisting of a perforated conveyor belt 12 and two carrier rolls 13 and 14, are arranged relative to the fiber flow transport devices 6 and 7 at an angle which is smaller than 90° to the transport direction of the non-woven fabric to be produced, and with each connected to a traverse drive unit 8 and 9. The carrier roll 13 is formed as a suction roll. Fiber feed rate control devices 10 and 11 each have a rotation unit with a dispersing roll 15 or 16. The fiber feed rate control device 10 is arranged to the non-woven fabric transport device at an angle of between 0° and 89°, at the beginning of the non-woven material transport device. However, the fiber feed rate control device 11 is arranged at an angle of 0° to the non-woven fabric transport device, above the non-woven fabric transport device. The fiber feed rate control devices 10 and 11 and the traverse drive units 8 and 9 have variable speed motors, which have not been illustrated. The modulation of the traverse drive units 8 and 9 is limited by adjustable working width position stops 17 to 20, located on the guide and drive rods 21 and 22. A suction air channel 23 is provided in the traverse level of the fiber feed rate control device 11 beneath the conveyor belt 12.

The mode of operation of the apparatus for the formation of a non-woven fabric, according to FIG. 6, is as follows:

Two partial fiber flows 5 of different types and/or color are individually supplied as fiber bands to the fiber flow transport device 6, which operates in a well-known manner, and transported into the fiber feed rate control device 10, the flow or feed rate is controlled in this device 10, i.e., preferably dispersed according to the carding principle, and deposited in the right quantity, via the effect of the dispersing roll 15, onto the conveyor belt 12, located next to one another at an angle position of between 0° and 89° to the non-woven fabric transport device, as depicted in FIG. 1. The fiber feed rate control device 10 generally moves continuously over the working width of the fiber layer to be produced, determined by the working width position stops 17 and 18. The non-woven fabric produced in this manner, not yet having its final structure and surface dimensions, arrives via the movement of the conveyor belt 12 beneath the traverse level of the fiber feed rate control device 11. The operation of this fiber feed rate control device 11 is to be understood as analogous to fiber feed rate control device 10, with the only difference being that in this case of the selected embodiment, a fiber flow 1 is inserted as fiber band in the non-woven transport device 7, with this fiber flow 1 being transported in the instantaneous setting of the fiber feed rate control device 11 of 0° to the transport direction of the non-woven fabric 2, fed onto the conveyor belt 12 at a controlled feed rate with the fibers being deposited in this particular direction as the last fiber layer. For both fiber feed rate control devices 10 and 11, the carrier and suction roll 13 and the suction air channel 23 act in a supporting and stabilizing fashion for the fiber layers being formed. The thus produced non-woven fabric 2 is guided over the transport device to the non-woven fabric reinforcement device.

If the transport of the non-woven fabric is continuous, zig-zag-like fiber layers are produced, the overlapping degree of which depend on the relationship between the speed of the traverse and the non-woven fabric transportation. The parallel arrangement of the fiber layers requires an intermittent drive of the non-woven fabric transportation device. The fiber feed rate control devices 10 and 11 can be controlled, together with the non-woven fabric transport devices 6 and 7, via the traverse drive units 8 and 9, in their movement over the working width, so that the formation of the various fiber layer thicknesses can be achieved.

Furthermore, the fiber flow insertions 24 are exchangeable, so that with the same fiber flow transport devices 6 and 7, one or more parital fiber flows can be supplied next to one another, or above one another, in arbitrary combination.

Figure 7:
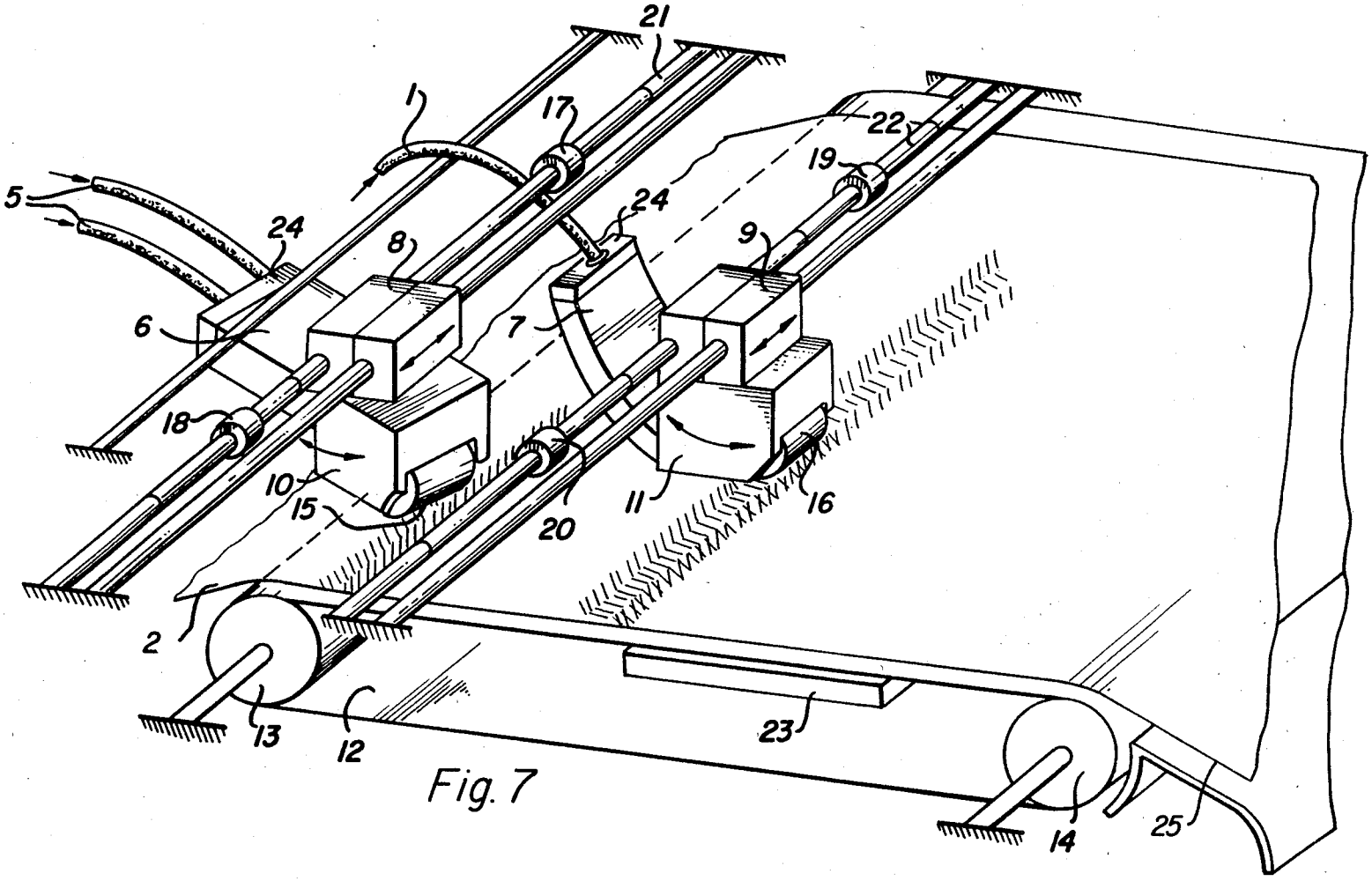
FIG. 7 is the schematic isometric depiction of the apparatus for the production of a non-woven fabric on a pre-manufactured sheet, according to FIGS. 4 and 5.

According to FIGS. 7 and 8, the pre-manufactured sheet 2 is supplied to the conveyor belt 12, on which the non-woven fabric 4 is formed and subsequently combined with the sheet. The mode of operation of the device for the production of multilayered sheets from non-woven fabrics and additional sheets 2 to form combined sheet 25, according to FIGS. 7 and 8, is analogous to the apparatus in FIG. 6.

Figure 8:
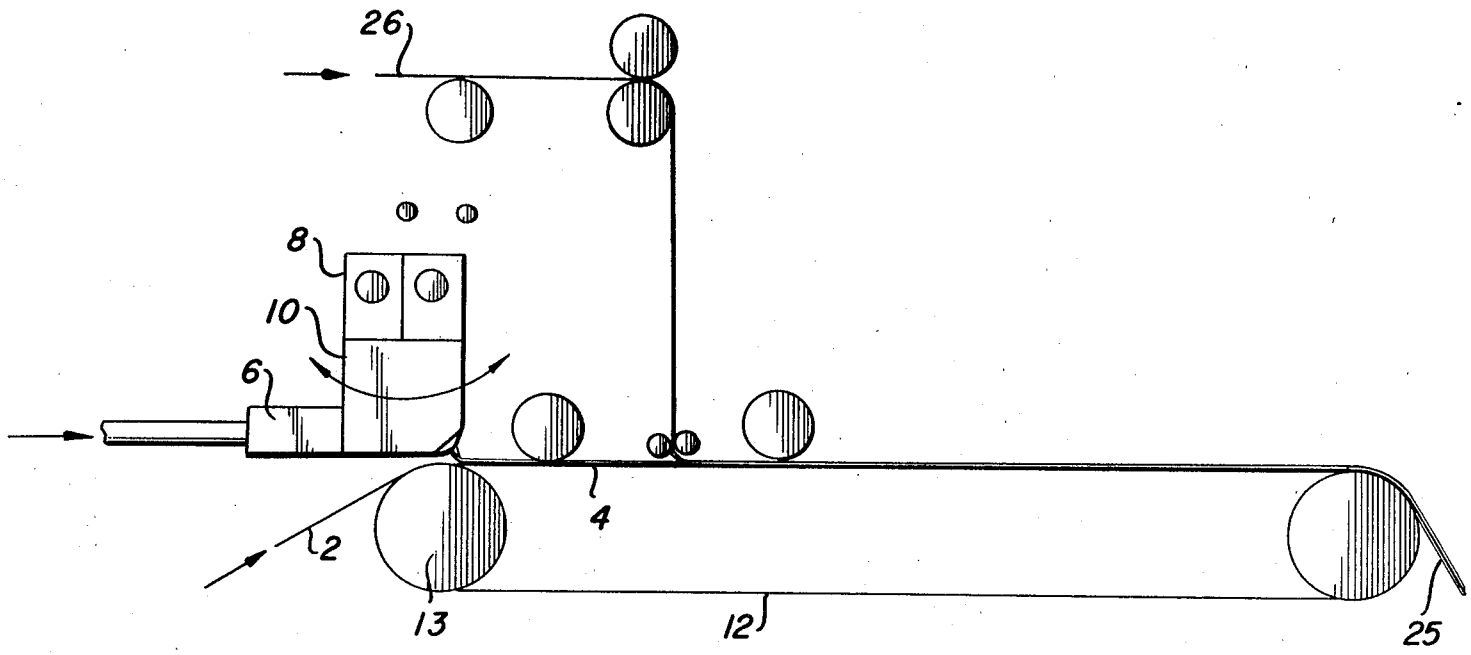
FIG. 8 is a side or lateral elevation view of the apparatus FIG. 7.

In FIG. 8, an additional sheet 26 is supplied and placed over the formed non-woven fabric 4. Thus, there is formed a three-layer sheet 25 with a non-woven intermediate layer 4, which is transported to the reinforcement device.

It thus will be seen that there is provided a method and apparatus for production of a non-woven fabric which attains the various objects of the invention and which is well adapted for the conditions of practical use. As numerous alternatives within the scope of the present invention will occur to those skilled in the art, besides those alternatives, equivalents, variations and modifications mentioned supra, it will be understood that the invention extends fully to all such alternatives, equivalents or the like, and is to be limited only by the scope of the recitations in the appended claims, and structural and functional equivalents thereof.

We claim:

1. An apparatus for the production of a non-woven fabric which comprises a movable solid transport element, said element having a substantially planar and displaceable substantially horizontal transport surface, said transport surface being capable of supporting a non-woven fabric to be produced, means to place said transport surface in linear motion, and in a generally rectilinear transport direction, first means to feed a fiber flow stream containing a plurality of discrete individual fibers onto said moving transport surface, and at an angle of less than 90° to the transport direction of the non-woven fabric to be produced, means for reciprocating said first feed means across said transport surface substantially perpendicular to the direction of motion of said transport surface and means for pivotally adjusting said feed angle of said first feed means, said first means to feed said fiber flow stream transversely disposing the fibers of said fiber flow stream next to one another on said moving transport surface, so as to form a substantially rectilinear independently oriented first fiber layer on said moving transport surface, said first fiber layer being independently oriented substantially transversely to the direction of movement of said transport surface, means to combine said formed first fiber layer including lateral border areas of said formed first fiber layer, with a preceding independently oriented second fiber layer, so as to reinforce the thus produced non-woven fabric, and means to recover a product non-woven fabric from said solid transport element.

2. The apparatus of claim 1, together with a second means to feed a fiber flow stream containing a plurality of discrete individual fibers onto the moving transport surface, and at an angle of less than 90° to the transport direction of the non-woven fabric to be produced, said second means to feed a fiber flow stream being spaced longitudinally away from said first means to feed a fiber flow stream, means for reciprocating said second feed means across said transport surface substantially perpendicular to the direction of motion of said transport surface and means for pivotally adjusting said feed angle of said second feed means, so that the fibers of said second fiber flow stream are transversely disposed next to one another on the moving transport surface, so as to form a third substantially rectilinear independently oriented fiber layer on the moving transport surface, said third fiber layer being independently oriented substantially transversely to the direction of movement of the transport surface, and means to combine said third fiber layer with at least one of the first fiber layer and the second fiber layer, so as to further reinforce the thus produced non-woven fabric.

3. The apparatus of claim 2, in which the second means to feed a fiber flow stream is disposed at a location downstream in a flow direction from the location of the first means to feed a fiber flow stream onto the moving transport surface, the angle at which the fiber flow stream is fed onto the moving transport surface by the second means to feed a fiber flow stream being substantially 0° to the transport direction of the non-woven fabric to be produced so that the fiber flow stream, which is fed by the second means onto the moving transport surface, is fed thereon in substantially the same direction as the direction of motion of the transport surface, and the first means to feed a fiber flow stream onto the moving transport surface feeds the fiber flow stream onto the transport surface at an angle in the range of between about 0° and 89° to the transport direction of the product non-woven fabric.

4. The apparatus of claim 1, in which the first means to feed the fiber flow stream onto the moving transport surface includes a terminal rotatable substantially cylindrical dispersing roll member, said dispersing roll member being juxtaposed to the moving transport surface, together with means to rotate said dispersing roll member.

5. The apparatus of claim 1, together with means to feed at least one pre-manufactured textile sheet onto the moving transport surface, so that said textile sheet is oriented contiguously and in registration with the formed product non-woven fabric.

6. The apparatus of claim 2, in which each of the first and second feed means includes a respective terminal rotatable substantially cylindrical dispsersing roll member juxtaposed to the moving transport surface and respective means for rotating each respective dispersing roll member.

* * * * *